US005424760A

United States Patent [19]

Wirth et al.

[11] Patent Number: 5,424,760

[45] Date of Patent: Jun. 13, 1995

[54] COVER INTERLOCK MECHASNISM FOR A THERMAL PRINTER LOCKS COVER WHILE PRINTING

[75] Inventors: Henry G. Wirth, Rochester; Robert F. Mindler, Churchville, both of N.Y.

[73] Assignee: Eastman Kodak Company, Rochester, N.Y.

[21] Appl. No.: 14,599

[22] Filed: Feb. 8, 1993

[51] Int. Cl.[6] ..... B41J 29/00; B41J 2/325

[52] U.S. Cl. ..... 342/222; 400/120.1

[58] Field of Search ..... 346/76 PH, 145; 400/120

[56] References Cited

U.S. PATENT DOCUMENTS 4,723,133 2/1988 Walter ..... 346/134
5,176,458 1/1993 Wirth ..... 400/120
5,198,836 3/1993 Saito et al. ..... 346/76 PH

FOREIGN PATENT DOCUMENTS 0440029 8/1991 European Pat. Off. ..... B41J 2/32

*Primary Examiner*—Huan H. Tran
*Attorney, Agent, or Firm*—Raymond L. Owens

[57] ABSTRACT

A cover interlock mechanism for a thermal printer is diclosed which locks the thermal printer cover when printing is being done and, when the print head is in a disassembled position, unlocks the cover.

3 Claims, 5 Drawing Sheets

COVER INTERLOCK MECHASNISM FOR A THERMAL PRINTER LOCKS COVER WHILE PRINTING

BACKGROUND OF THE INVENTION

1. Field of Invention

The present invention relates to a color thermal printing system which has a cover that opens for service and for changing donor supply and takeup spools.

2. Description of the Prior Art

Thermal printers often provide a mechanism to replace the thermal dye donor media and/or the dye receiver media in the printer by opening a portion of the printer. To open the printer, the user releases a latch in a cover mechanism and swings the cover open to gain access to the media supplies. These cover mechanisms are usually located in the top portion of the printer, opening upward.

The cover mechanism can have some of the major printer components attached to it, so that as the cover is swung open these components move away from media to permit easier loading of new media or for maintenance. The cover mechanism usually has a hinge or pivot axis along one side and a latch which keeps the cover closed during operation but permits opening the cover for loading media. To permit proper latch operation and opening, the cover cannot be rigidly locked to the rest of the thermal printer structure. The latch can usually be operated at any time, without regard to current printer operational status. Thus it is possible to open the cover mechanism when the printer is operating. Such situations can result in defective prints, operating problems requiring user intervention or even damaged equipment.

SUMMARY OF THE INVENTION

The object of the present invention is to eliminate defective prints, media jams and printer equipment damage caused by opening the cover mechanism when the printer is operating.

This object is achieved in a thermal printer with a main support structure, comprising a rotatably mounted cover mechanism, movable between open cover and closed cover positions, including latching means for holding the cover mechanism in the closed cover position during operation and permitting the cover mechanism to be moved to the open cover position at other times; a print head assembly movable between a print position and a retracted position; and an interlock mechanism responsive to the position of the print head assembly, such that when the print head assembly is in the print position, the interlock mechanism locks the latching means in a closed latch position to prevent moving the cover mechanism from the closed cover position, and further when the print head assembly is in the retracted position, the interlock mechanism releases the latching means to permit the cover mechanism to be moved to the open cover position. In the present invention, an interlock mechanism locks a latch mechanism in a closed position when a print head assembly is in a printing position, and the latch mechanism is unlocked when the print head assembly is in a retracted position, permitting opening of the cover mechanism.

Advantages

The following are the advantages of this invention:

1) a cover mechanism can be opened only when it will not interfere with printer operation;

2) a simple interlock mechanism of few parts which provides a solid mechanical lock for the cover mechanism, thereby preventing opening of the cover mechanism during printing; and 3) prevention of defective prints, media jams and printer equipment damage which may result from opening the cover mechanism during printer operation.

DESCRIPTION OF THE PREFERRED EMBODIMENT

An embodiment of the present invention will be described by referring to FIGS. 1 to 5A,B.

Figure 1:
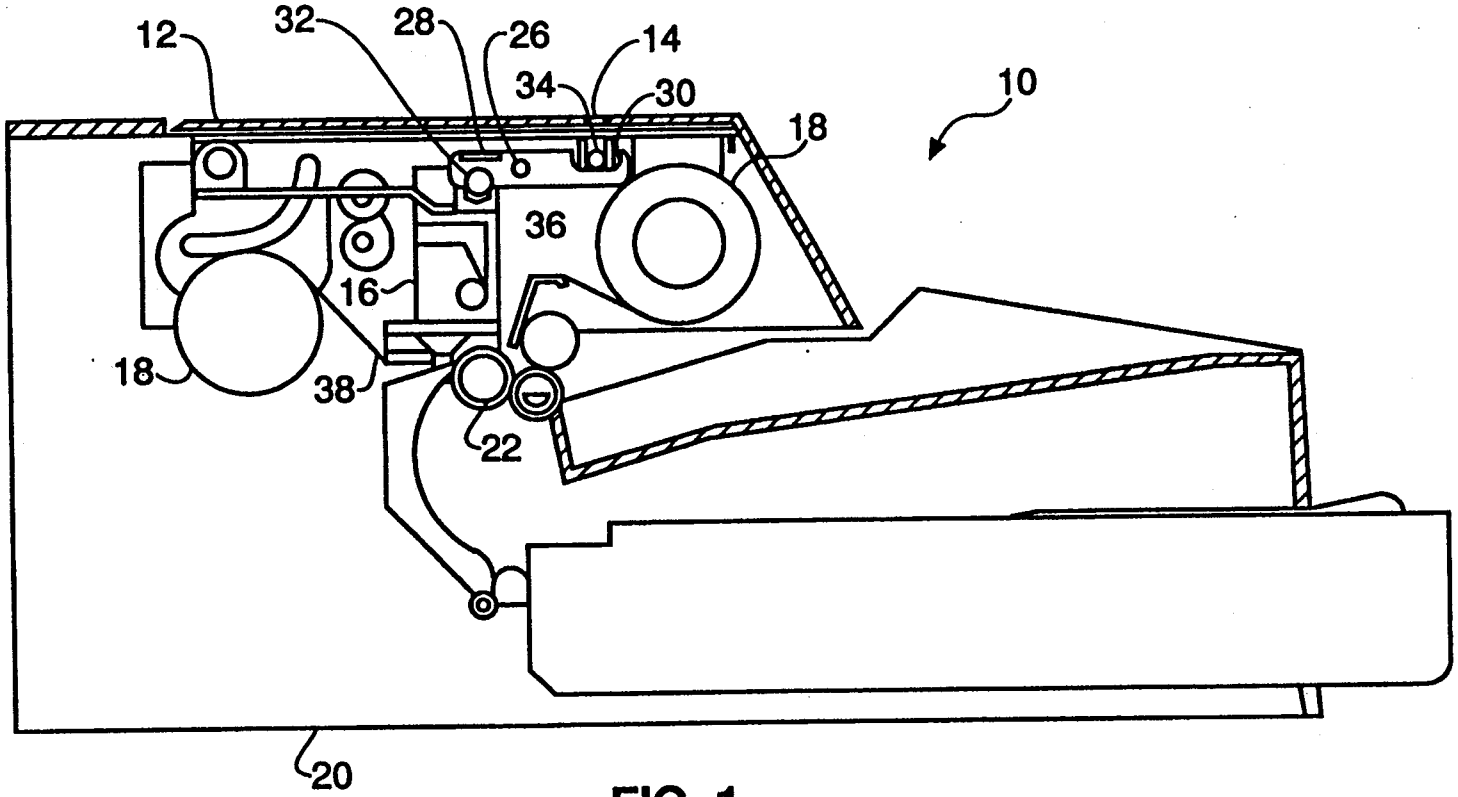
FIG. 1 shows a sectional view of a thermal printer according to the present invention.

FIG. 1 shows a thermal printer 10 of the present invention wherein a cover mechanism 12 has several components attached to it. These components include a latch 14, a print head assembly 16 and dye donor supply spools 18. The cover mechanism 12 is mounted to a main support structure 20. When the latch 14 is released, the cover mechanism 12 can rotate to an open position. The main support structure 20 includes a roller platen assembly 22. The thermal printer 10 is shown as it operates, with the cover mechanism 12 in a closed position.

During normal thermal printer operations, the print head assembly 16 can move to occupy at least two positions—(1) a printing position in which the print head assembly 16 is urged toward the platen 22, simultaneously pressing a dye donor and dye receiver and printing information thereon, and (2) a retracted position in which the print head assembly 16 is spaced away from the platen 22. The printer normally loads or ejects dye receiver media 24 with the print head assembly 16 in the retracted position. More than one retracted position can be used for the loading and ejecting phases of operation.

During printing, the print head assembly is urged toward the platen, pressing the dye donor and dye receiver media between them.

Figure 2:
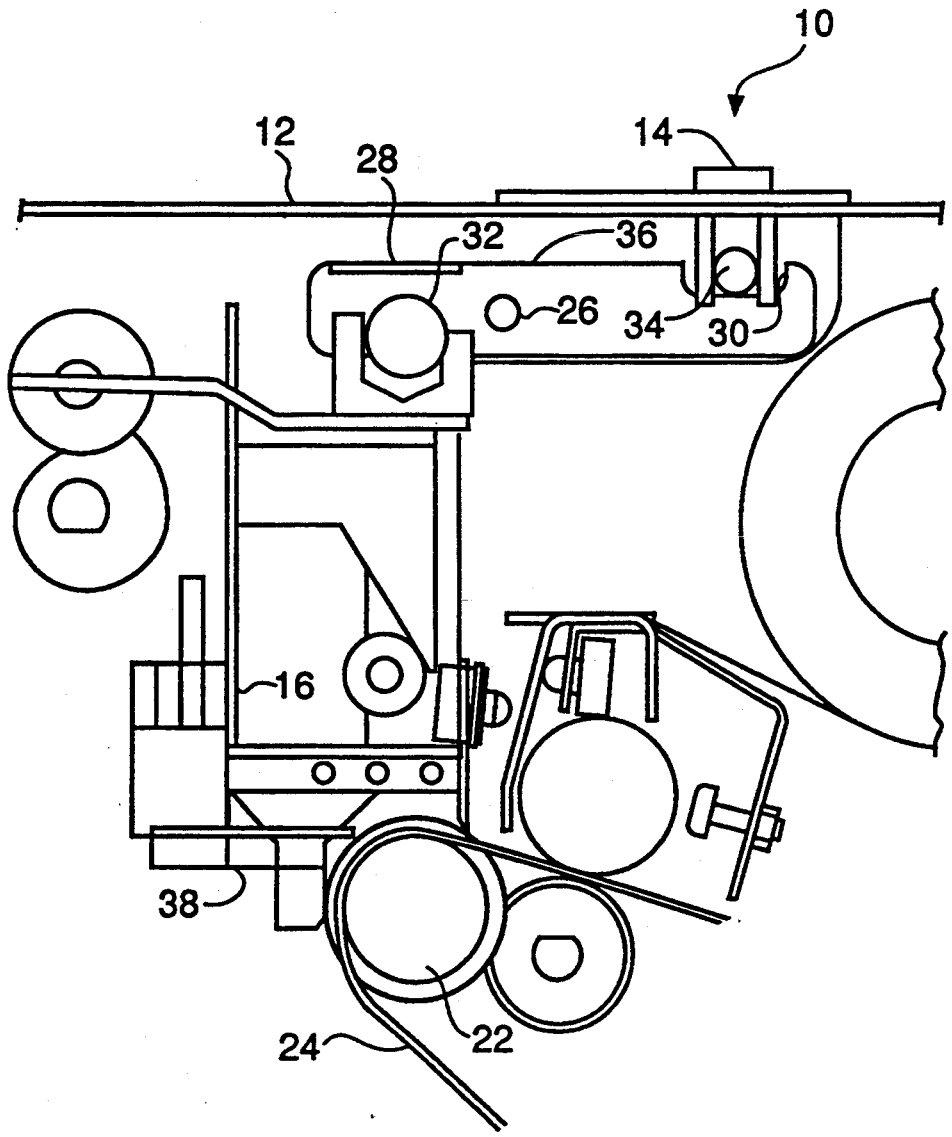
FIG. 2 is an enlarged sectional view portraying FIG. 1's mechanism in more detail, showing the print head assembly, head positioning mechanism and cover mechanism in a print position.

FIG. 2 shows the print head assembly 16 in the print position, a latch 14 in a closed position, and an interlock 36 in a locked position. The interlock 36 is pivotally mounted on a pivot pin 26. The interlock 36 further includes or defines a interlock engaging surface 28 on one end and a rod engaging surface 30 on the other end.

An interface surface 32, shown in this embodiment as a pin, is attached to the print head assembly 16 is spaced away from the interlock engaging surface 28. It is recognized that alternative embodiments could utilize other features or components of the print head assembly for engaging the interlock engaging surface.

The latch 14 can move side to side from a closed position to an open position. As the latch 14 moves, a locking rod 34 is urged from a closed position where the cover mechanism 12 is locked closed to an open position where the cover mechanism can be opened. When the interlock 36 is in the locked position, the rod engaging surface 30 restricts the motion of the locking rod 34 so that the locking rod 34 remains in its closed position. Restricting the locking rod 34 to its closed position further restricts the latch 14 to its closed position, thus locking the cover mechanism 12 in its closed position.

Figure 3A:
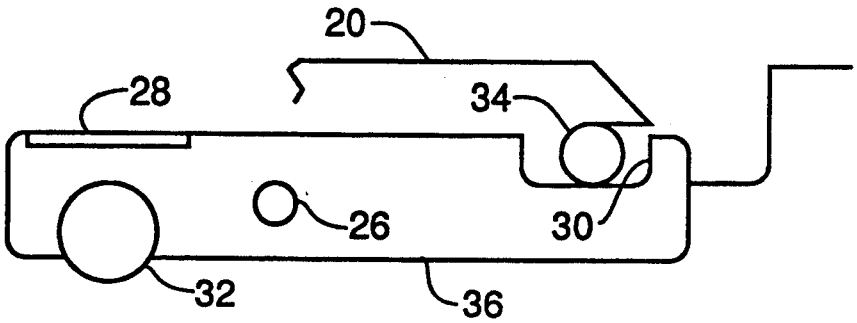
FIGS. 3A and B show a side and end view, respectively, of a interlock mechanism in the print position, in which the interlock mechanism locks the latch in a closed position.
Figure 3B:
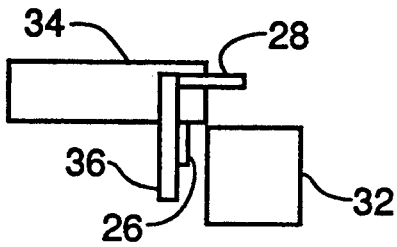

FIGS. 3A and B shows a side and end view respectively of the relative positions of the locking rod 34, the interlock 36 and the interlock surface 32 when the print head assembly 16 (not shown) is in its print position.

When the printer has completed the printing operation, the print head assembly moves from the print position to the retracted position, permitting ejection of the finished print on the dye receiver media and subsequent loading of a new dye receiver media for the next print.

Figure 4:
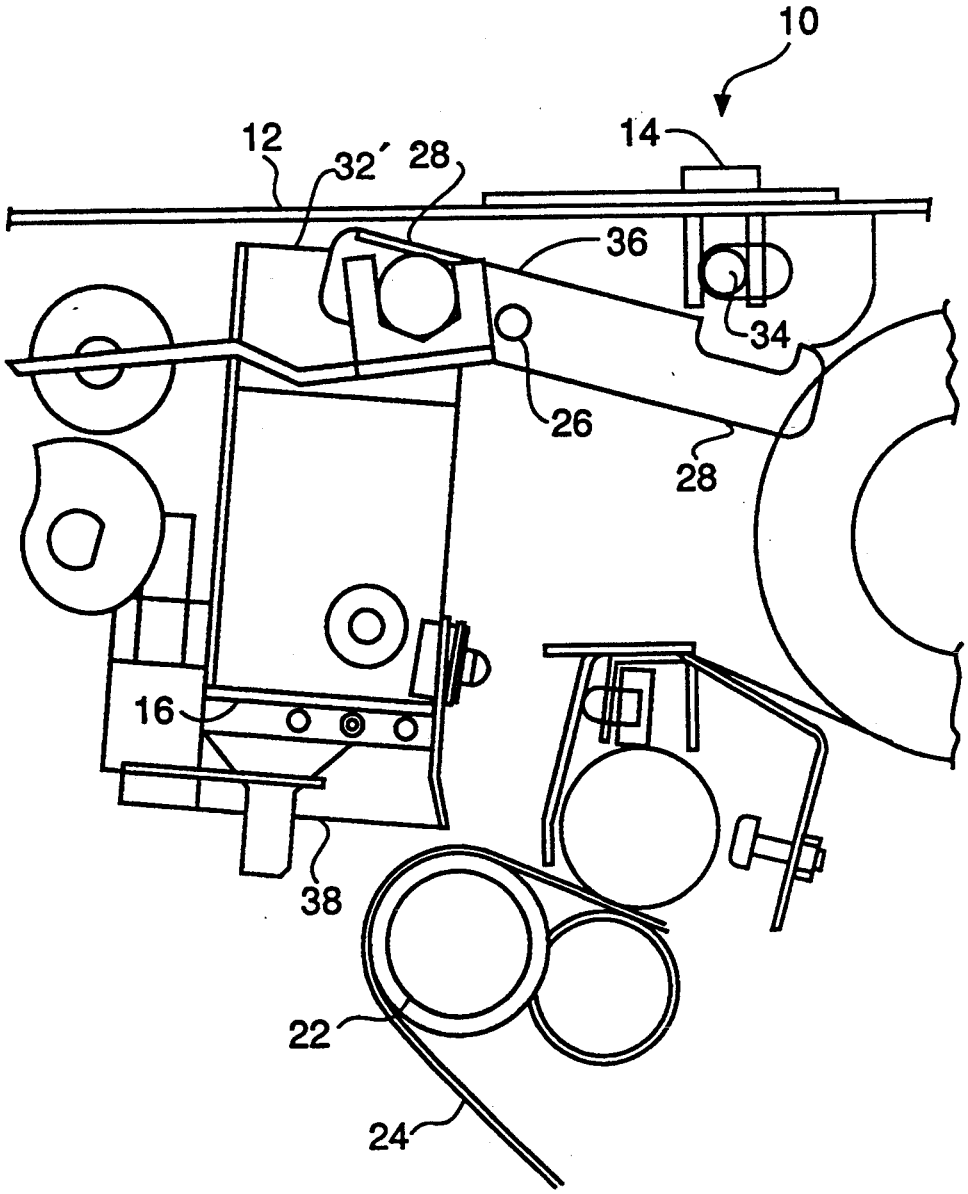
FIG. 4 is an enlarged sectional view of FIG. 1's mechanism, similar to FIG. 2 except the print head assembly, head positioning mechanism and cover mechanism are in a retracted position.

FIG. 4 shows the print head assembly 16 in the retracted position, such as used for ejecting a finished print. When print head assembly 16 moves from the print position toward the retracted position, the interlock surface 32 contacts the interlock engaging surface 28. As the print head assembly continues its movement to the retracted position, the interlock surface 32 presses against the interlock engaging surface 28, causing the interlock 36 to rotate about the pivot pin 26. When the print head assembly 16 reaches the retracted position, the interlock 36 has rotated sufficiently such that the rod engaging surface 30 no longer restricts the movement of the locking rod 34.

Figure 5A:
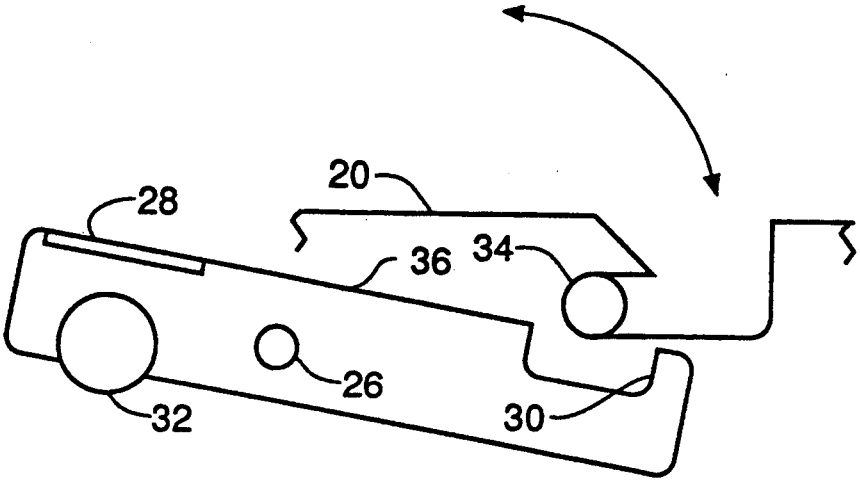
FIG. 5 A and B show a side and end view, respectively, of the interlock mechanism, similar to FIG. 3 except the interlock mechanism is in the released position, unlocking the latch to permit opening of the cover mechanism.
Figure 5B:
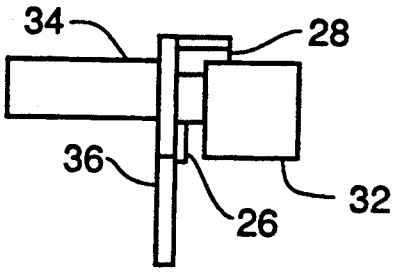

FIGS. 5A and B shows a side and end view respectively of the relative positions of the locking rod 34, the interlock 36 and the interlock surface 32 when the print head assembly 16 (see FIG. 4) is in the retracted position. The interlock surface 32 presses against the interlock engaging surface 28, rotating the interlock 36 so that the rod engaging surface 30 no longer restricts the locking rod 34. When the print head assembly 16 is in the retracted position, the latch 14 can be moved from the closed to the open position because the locking rod 34 can now move freely from the illustrated locked position to an unlocked position.

The print head assembly 16 can also be moved to an intermediate retracted position between the printing and retracted positions shown in FIGS. 2 and 4. This intermediate retracted position can be used for loading a new dye receiver media. When the print head assembly 16 is in this intermediate retracted position, the locking rod engaging surface 32 of the interlock still restricts the movement of the locking rod, locking the cover mechanism in the closed position. Thus, the cover mechanism can be opened only when the print head is in the retracted position.

The invention has been described in detail with particular reference to certain preferred embodiments thereof, but it will be understood that variations and modifications can be effected within the spirit and scope of the invention.

What is claimed is:

1. A thermal printer with a main support structure, said printer comprising:

a) a rotatably mounted cover mechanism movable between open cover and closed cover positions, said cover mechanism including latching means for holding the cover mechanism in the closed cover position during operation, said latching means being releasable to permit the cover mechanism to be moved to the open cover position at other times;

b) a print head assembly movable between a print position and a retracted position; and c) an interlock mechanism responsive to the position of said print head assembly such that, when said print head assembly is in the print position, said interlock mechanism prevents release of said latching means to prevent moving said cover mechanism from the closed cover position, and further when said print head assembly is in the retracted position, said interlock mechanism releases said latching means which thereby permits said cover mechanism to be moved to the open cover position.

2. A thermal printer as set forth in claim 1, wherein said latching means includes:

a) a latch movable between closed and open positions; and b) a locking rod, movable between closed and open positions in response to the position of said latch, such that when said latch is in its closed position said locking rod is in its closed position, thereby locking said cover mechanism in the closed cover position, and further when said latch is in its open position, said locking rod is in its open position, thereby unlocking said cover mechanism so that said cover can be moved to the open cover position.

3. A thermal printer as set forth in claim 2, wherein:

a) said print head assembly includes an interlock surface; and b) said interlock mechanism includes a rotatably mounted interlock plate having a rod engaging surface and an interlock engaging surface whereby, when said print head assembly is in the print position, said interlock surface is spaced away from said interlock engaging surface and said rod engaging surface engages said locking rod, thereby restraining said locking rod in position its closed and further, when said print head assembly is in the retracted position, said interlock surface engages said interlock engaging surface, causing said interlock plate to rotate until said rod engaging surface disengages said locking rod so it can move from its position to its open position, thereby permitting movement of said cover mechanism to the open cover position.

* * * * *

UNITED STATES PATENT AND TRADEMARK OFFICE

CERTIFICATE OF CORRECTION

PATENT NO. : 5,424,760
DATED : June 13, 1995
INVENTOR(S) : Henry G. Wirth, et al It is certified that error appears in the above-indentified patent and that said Letters Patent is hereby corrected as shown below:

Col. 4, Claim 3, line 54, change "position its closed" to --its closed position--

Col. 4, Claim 3, line 60, before "position" insert --closed--

Signed and Sealed this

Twenty-sixth Day of December, 1995

*Attest:*

Bruce Lehman

BRUCE LEHMAN

*Attesting Officer*

*Commissioner of Patents and Trademarks*